US010400392B2

(12) United States Patent
Rahikkala et al.

(10) Patent No.: US 10,400,392 B2
(45) Date of Patent: Sep. 3, 2019

(54) MEASUREMENT APPARATUS AND METHOD

(71) Applicant: VALMET AUTOMATION OY, Espoo (FI)

(72) Inventors: Arvo Rahikkala, Kajaani (FI); Kari Lampela, Norcross, GA (US)

(73) Assignee: VALMET AUTOMATION OY, Espoo (FI)

( * ) Notice: Subject to any disclaimer, the term of this patent is extended or adjusted under 35 U.S.C. 154(b) by 703 days.

(21) Appl. No.: 14/875,055

(22) Filed: Oct. 5, 2015

(65) Prior Publication Data

US 2017/0096774 A1 Apr. 6, 2017

(51) Int. Cl.

| | |
|---|---|
| ***D21C 9/10*** | (2006.01) |
| ***D21C 9/02*** | (2006.01) |
| ***D21C 9/14*** | (2006.01) |
| ***D21C 9/12*** | (2006.01) |
| ***D21H 21/32*** | (2006.01) |

(52) U.S. Cl.

CPC ..... *D21C 9/1052* (2013.01); *D21C 9/02* (2013.01); *D21C 9/1005* (2013.01); *D21C 9/123* (2013.01); *D21C 9/14* (2013.01); *D21C 9/142* (2013.01); *D21H 21/32* (2013.01)

(58) Field of Classification Search

CPC . D21C 9/02; D21C 9/14; D21C 9/142; D21C 91/052

See application file for complete search history.

(56) References Cited

U.S. PATENT DOCUMENTS

| | | | |
|---|---|---|---|
| 4,013,506 | A | 3/1977 | Histed et al. |
| 4,348,256 | A | 9/1982 | Bergstrom et al. |
| 2014/0273244 | A1 | 9/2014 | Bolduc et al. |

FOREIGN PATENT DOCUMENTS

| | | | |
|---|---|---|---|
| WO | 99/35482 | A1 | 7/1999 |
| WO | 99/39044 | A1 | 8/1999 |
| WO | 00/65147 | A1 | 11/2000 |

OTHER PUBLICATIONS

Beder-Miller et al., Optimizing Your Process Through Lignin Management, 2015, PaperWeek Canada.*

Andersson et al., On The Impact of Dissolved Ligning in Oxygen Delignification and Chlorine Dioxide, Oct. 2015, TAPPI PEERS.*

(Continued)

*Primary Examiner* — Anthony Calandra

(74) *Attorney, Agent, or Firm* — Oliff PLC

(57) ABSTRACT

A bleaching apparatus comprises a measurement chamber has a first substance, the amount of the first substance in the measurement chamber being known. A dosing unit inputs a second substance to the measurement chamber for causing a chemical reaction between the first substance and the second substance, one of the first substance and the second substance being chlorine dioxide and another of the first substance and the second substance being filtered sample from pulp slurry of a pulp process. At least one sensor performs detection of a property known to depend on the chemical reaction between the first substance and the second substance as a function of time. A data processing unit determines chemical demand of chlorine dioxide for washing loss in a bleaching sub-process on the basis of at least one value in the detected property within a known period of time after the input of the second substance.

7 Claims, 4 Drawing Sheets

(56) References Cited

OTHER PUBLICATIONS

Gilbert A. F., Spectrophototometric Measurment of Chlorine Dioxide Residual in Kraft Pulp Bleaching, 1986, IFAC Instrumentation and Automation in the Paper, Rubber, Plastics and Polymerization Industries, p. 47-52.*
Wilke Caroline, The Impact of Dissolved Matter on Fiberline Processes, 2018, Karlstad University (Doctoral Thesis).*
Brogdon Brian, Revised Steady-Stae Model for Chlorine Diopxide Brightening that Considers Extraction Washer Carryover Effects, Feb. 2016, PaerWeek Canda.*
Oct. 2, 2018 Search Report issued in European Patent Application No. 16 85 3148.
Rice Matthew, "New Techniques for Continuous Chemical Analysis in the Pulp & Paper Indsustry," Royal Institute of Technology, 2001, 80 pages.
Kopra Riku, "Application of the refractometer in the measurement and monitoring of brown stock washing," Aalto University, 2015, 74 pages.
Mar. 3, 2017 Search Report issued in PCT International Patent Application No. PCT/FI2016/050687.

* cited by examiner

MEASUREMENT APPARATUS AND METHOD

FIELD

The invention relates to a measurement apparatus and method.

BACKGROUND

Pulp is washed for eliminating the black liquor in the pulp as effectively as possible. The sub-process of washing thus decreases consumption of chlorine dioxide which is used in the bleaching sub-process. The washing loss a.k.a carry-over, which refers to the amount of organic matter in the pulp and which causes a demand of chlorine dioxide in bleaching, has been measured as COD (Chemical Oxygen Demand) load on the basis of electrical conductivity of unbleached pulp. Another method for determining COD load is based on a measurement of an optical property of unbleached pulp. However, the present methods are old fashioned and not accurate enough for environmentally friendly bleaching required today.

Thus, there is need to have a better solution to measurement of chemical demand for chlorine dioxide.

BRIEF DESCRIPTION

The present invention seeks to provide an improved solution for measurement of chemical demand of chlorine dioxide.

Preferred embodiments of the invention are disclosed in the dependent claims.

The solutions according to the invention provide several advantages. The demand and/or concentration of the bleaching chemical for washing loss can be determined accurately. The amount of the bleaching chemical input to a sub-process may be controlled effectively on the basis of the determined chemical demand.

BRIEF DESCRIPTION OF THE DRAWINGS

Example embodiments of the present invention are described below, by way of example only, with reference to the accompanying drawings, in which.

DETAILED DESCRIPTION

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Figure 1A:
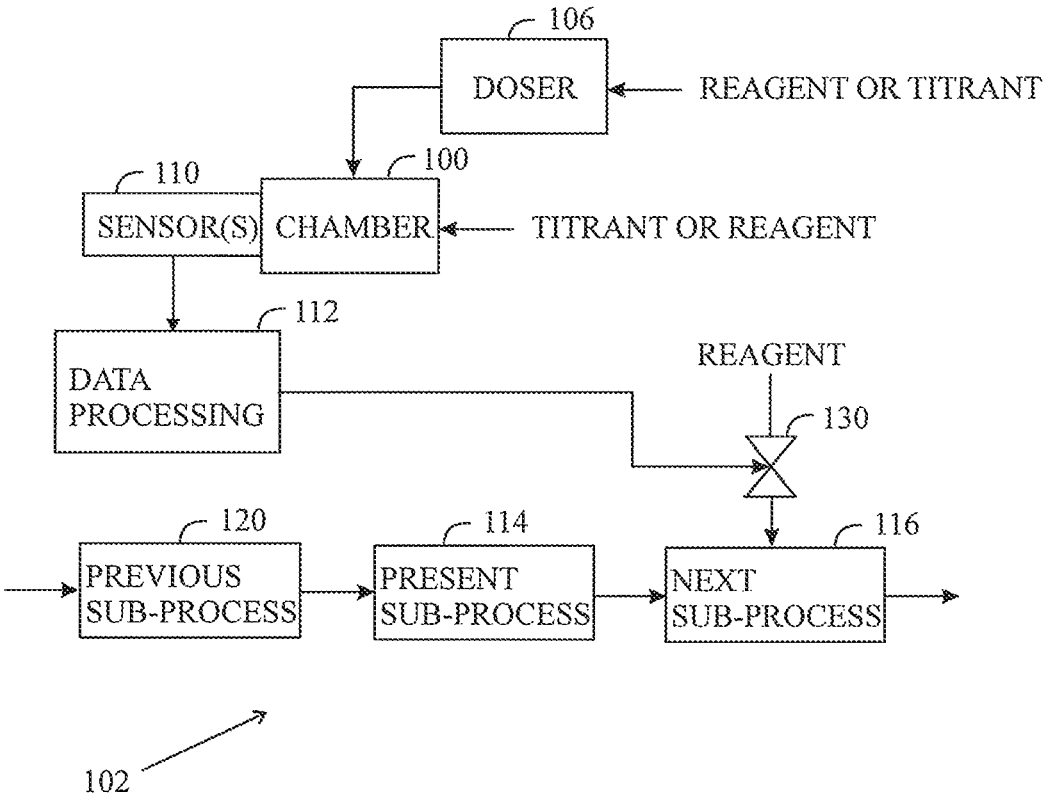
FIG. 1A illustrates a general example of a measurement system.

FIG. 1A illustrates an example an apparatus for determining a parameter associated with chlorine dioxide used in chemical bleaching of pulp slurry. The apparatus comprises a measurement chamber 100. The chamber 100 may be an enclosed compartment or receptacle which may receive or contain a first substance 104 associated with a pulp process 102. The first substance 104 is freely flowing substance like liquid or suspension, for example. The chamber 100 may receive continuously the first liquid-like substance 104 which then flows out of the chamber 100. In an embodiment, the chamber 100 may be an overflow-type of chamber. The chamber 100 may a batch-type of chamber which repeats a cycle of taking an amount of the first substance 104 for the measurement and then outputting the measured first substance 104 in order to intake a new amount of the first substance 104.

The amount of the first substance 104 in the measurement chamber 100 during the measurement is known. In an embodiment, the measurement chamber 100 may have a predetermined volume, and if the measurement chamber 100 is filled full, the amount of the first substance 104 will be known. In an embodiment, the measurement chamber 100 may receive a predetermined volume or mass of the first substance 104 which also makes the amount of the first substance 104 known.

The apparatus comprises a dosing unit 106 for inputting a second substance 108 to the measurement chamber 100. The amount of the second substance 108 input to the measurement chamber 100 is known. In general, one of the first substance 104, 104R and the second substance 108, 108R comprises chlorine dioxide and another of the first substance 104, 104R and the second substance 108, 108R is a filtered sample from pulp slurry of a pulp process 102. The filtered sample corresponds to a substance of washing loss which causes chemical demand in a bleaching sub-process.

The second substance 108 may be a titrant for the first substance 104, and the first substance 104 may include a reagent. The second substance 108 may be a filtered sample (or a reference sample) and the first substance 104 may include chlorine dioxide or vice versa. Substance including chlorine dioxide may be in a form of solution. The solution may be a water solution. The strength of chlorine dioxide may be the same as what is used in the process of bleaching. Then its strength doesn't necessarily need to be known. However, the strength of chlorine dioxide is often known. The strength of chlorine dioxide may typically be about 8 to 12 g/liter (chlorine dioxide in liter).

The dosing unit 106 may comprise a pump, which may be micro pump, or a burette. The dosing unit 106 may increase the amount of the second substance 108 for causing a chemical reaction between the first substance 104 and the second substance 108 in the measurement chamber 100. The number of doses may be one or more. The dosing may be performed as a function of time. The increase of the second substance 108 may be discrete or continuous. The discrete increase may be performed drop by drop, for example. An amount of one drop may be so small that such an amount alone without other drops preceding it cannot cause the chemical reaction between the first and the second substances 104, 108 to reach or cross an endpoint 400 (shown in FIGS. 4A to 4D and explained in text related thereto).

In an embodiment, the discrete increase may be performed such that the first input amount of the second substance 108 is large enough to cause the chemical reaction between the first and the second substances 104, 108 to reach an endpoint 400 (shown in FIGS. 4A to 4D)

The continuous increase may be performed as a continuous flow where at least a first instantaneous amount of the second substance 108 is so small that it cannot cause the chemical reaction between the first and the second substances 104, 108 to reach or cross an endpoint 400 (shown in FIGS. 4A to 4D).

The total amount of the second substance 108 input to the measurement chamber 100 discretely or continuously by the dosing unit 106 is larger than the chemical demand of the first substance 104 for reaching or crossing the endpoint 400 (shown in FIGS. 4A to 4D).

The apparatus comprises at least one sensor 110 for performing detection of a property known to depend on the chemical reaction between the first substance 104 and the second substance 108 as a function of time. The chemical reaction may be simultaneous with the input of the at least one discrete amount of the second substance 108 into the measurement chamber 100. In general, the at least one sensor 110 is configured to detect directly or indirectly the content or the amount of chlorine dioxide in the measurement chamber 100. The at least one sensor 110 may be configured to detect the relative content or amount of chlorine dioxide in the measurement chamber 100. The content or the amount of the chlorine dioxide in the measurement chamber 100 may be measured as strength, concentration or percentage.

In an embodiment, the chemical reaction may be measured with electrodes of a multi-electrode system of the at least one sensor 108. A diffusion current required to keep a constant potential is proportional to the concentration of the mixture of the first substance 104 and the second substance 108 in the measurement chamber 100. The at least one sensor 108 may thus perform detection of the mixture of the first substance 104 and the second substance 108 electrochemically. The electrochemical measurement of the concentration of a liquid-like substance in the measurement chamber 100 is known, per se, which is why the electrochemical measurement needs not to be explained more.

Figure 1B:
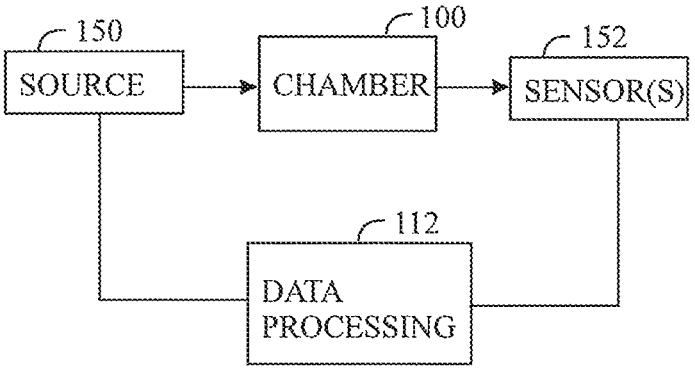
FIG. 1B illustrates an example of an optical measurement configuration for determining concentration of chlorine dioxide.

In an embodiment shown in FIG. 1B, the at least one sensor 110 comprises a light source 150 and at least one optical detector 152. The light source 150 may output optical radiation which may include at least one of the following: ultraviolet light, visible light and infrared light. The optical radiation output by the light source 150 may be directed through the measurement chamber 100. The chemical reaction between the first substance 104 and the second substance 108 may cause a change in an absorption spectrum measured through the mixture of the first substance 104 and the second substance 108. Instead of transmittance measurement, reflectance spectrum of the mixture of the first and second substance 104, 108 in the measurement chamber 100 may be measured. Namely, the reflectance of the mixture may vary with the chemical reaction. The optical measurement needs not to be explained more because the dependence of the optical property of a liquid-like substance on the concentration is known, per se.

In this application, the concentration means strength of the mixture in the measurement chamber 100. The concentration may refer to an amount of the first substance dissolved in the known amount of the second substance. Alternatively, the concentration may refer to an amount of the second substance dissolved in the known amount of the first substance. The concentration may be expressed in moles per cubic meter.

The apparatus comprises a data processing unit 112 which determines a parameter associated with chemical demand of chlorine dioxide for washing-loss in a bleaching sub-process on the basis of one or more values in the detected property. At least one of the one or more values is detected at or after crossing an endpoint 400 (see FIGS. 4A to 4D).

The parameter may indirectly be strength of chlorine dioxide or directly the chemical demand of chlorine in the bleaching sub-process. The measurement may be performed within a known period of time after the input of the second substance 108. In this manner, an amount of chlorine dioxide which has not reacted with the titrant by the measured moment will be known. As it is also known how much chlorine dioxide is involved in the reaction in the chamber 100 by the measured moment, the amount of consumed chlorine dioxide may be computed as difference between the two.

In an embodiment, the data processing unit 112 may search for an endpoint 400 (see FIGS. 4A to 4D) of titration associated with the chemical reaction, and to determine the parameter associated with chemical demand for chlorine dioxide for bleaching of washing loss on the basis of the endpoint 400 of the detected property of the chemical reaction.

The property of the chemical reaction of titration is detected by the at least one sensor 110. The endpoint 400 is associated with chemical demand for chlorine dioxide which is used in a beaching sub-process of pulp. Chlorine dioxide may be dosed to the measurement chamber 106 by a valve 130. The valve 130 may be controlled by the data processing unit 112. Chlorine dioxide is included in either of the first substance 104 or the second substance 108.

The data processing unit 112 may also control the dosing of a substance comprising chlorine dioxide to a next sub-process 116 which follows the present sub-process 114 on the basis of the determined parameter associated with the chemical demand of chlorine dioxide. The next sub-process 116 may be a bleaching sub-process. The control principle is shown with a line to a valve 132 which adjusts the flow of substance including chlorine dioxide to the bleaching sub-process 116. The valve 132 may be controlled by the data processing unit 112.

In an embodiment, the dosing unit 106 may input chlorine dioxide to the measurement chamber 100 which has the filtered sample 108P, the input amount of chlorine dioxide 104R at one time being higher than the chemical demand of the filtered sample 108P. Chlorine dioxide may a part of a liquid-like first substance 104R which is input to the measurement chamber 100.

In an embodiment, the dosing unit 106 may input the filtered sample 108P to the measurement chamber 100 which has chlorine dioxide, the amount of chlorine dioxide 104R in the measurement chamber 100 being higher than the chemical demand of the filtered sample 108P input at one time for reaching or crossing the endpoint 400. Thus, the dosing unit 106 inputs a known volume of the filtered sample 108P to the measurement chamber 100 at a time, the volume causing the chemical reaction to reach or cross the endpoint 400. The measurement chamber 100 may have a substance which includes chlorine dioxide, the amount of chlorine dioxide 104R, per se, in the measurement chamber 100 being thus higher than the chemical demand of the filtered sample 108P input at one time. Because the ranges of strength of chlorine dioxide and the chemical demand of the filtered sample can be estimated on the basis of experience, for example, suitable amounts of the filtered sample and the substance including chlorine dioxide may be used in the measurement.

Figure 2:
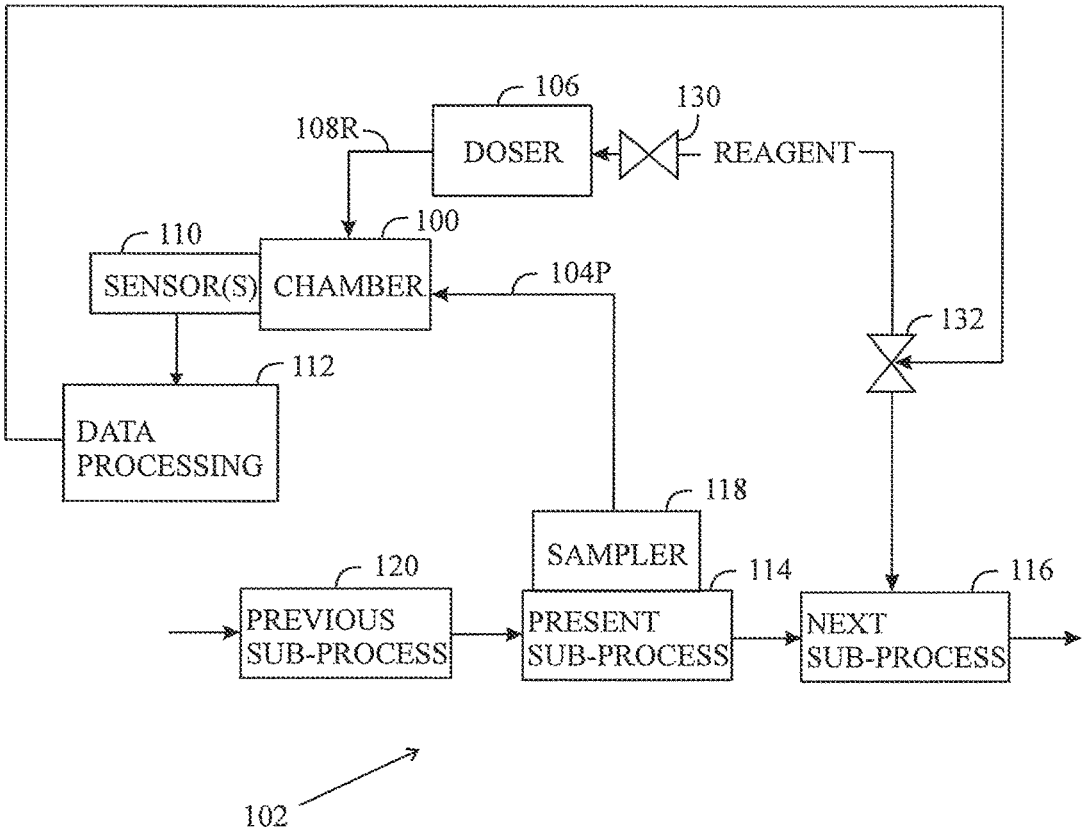
FIG. 2 illustrates an example of measurement of chlorine dioxide by dosing chlorine dioxide to a filtered sample.

In an embodiment shown in FIG. 2, the measurement chamber 100 may have a filtered sample 104P of a known amount from a present sub-process 114 of the pulp process 102. The filtering may have been performed using a screen extractor or a mechanical filter with holes the diameter of which is about 150 μm, for example. Consistency of pulp may be about 10% whereas consistency of the filtered sample may be about 0.015%, for example. The values of diameter and consistencies are, however, not limited to these values. The dosing unit 106 may input chlorine dioxide 108R to the measurement chamber 100 for causing a chemical reaction between chlorine dioxide 108R and the filtered sample 104P. The dosing unit 106 may input a substance including chlorine dioxide 108R to the measurement chamber 100 for causing a chemical reaction between chlorine dioxide 108R and the filtered sample 104P. The at least one sensor 110 may perform the detection of the property known to depend on the chemical reaction between chlorine dioxide 108R and the filtered sample 104P. The data processing unit 112 may determine chemical demand of chlorine dioxide for washing loss in the bleaching sub-process 116 of the pulp process on the basis of the detection of the endpoint 400. The data processing unit 112 may control the input of chlorine dioxide as such or as a part of another substance in the bleaching sub-process 116 on the basis of the determined chlorine dioxide demand.

In an embodiment, the apparatus may comprise a sampler 118 which may take a continuous filtered sample flow from the pulp process and forward the filtered sample flow to the measurement chamber 100. In an embodiment, the sampler 118 may take separate filtered samples, such as batches, from the pulp process and forward the filtered samples one by one to the measurement chamber 100. The sampler 118 is known, per se. The at least one sensor 110 may detect each mixture of the filtered samples and chlorine dioxide sample by sample, and the data processing unit 112 may measure the mixed samples individually.

In an embodiment, the dosing unit 106 may input the second substance 108, 108P, 108R to the measurement chamber 100 which has a known amount chlorine dioxide by increasing the amount of the second substance 108, 108P, 108R for causing a chemical reaction between the first substance 104, 104P, 104R and the second substance 108, 108P, 108R whereby the increase at one moment being less than required to cause the chemical reaction to reach or cross the endpoint 400. The at least one sensor 110 may then perform the detection of the property simultaneously with the input of the second substance 108, 108P, 108R.

In an embodiment, the measurement chamber 100 may have a filtered sample 104P. The filtered sample 104P may be a filtered sample of pulp. The dosing unit 106 may input chlorine dioxide 108R to the measurement chamber 100 by increasing the amount of chlorine dioxide 108R for causing a chemical reaction between chlorine dioxide 108R and the filtered sample 104P. Chlorine dioxide may be input as such or more conveniently chlorine dioxide may be mixed in another substance during input. The at least one sensor 110 may perform the detection of the property known to depend on the chemical reaction between chlorine dioxide 108R and the filtered sample 104P simultaneously with the input of chlorine dioxide 108R. The data processing unit 112 may determine the parameter associated with chemical demand of chlorine dioxide 108R which is to be used in the bleaching sub-process 116 of the pulp process 102 on the basis of the endpoint 400 (see FIGS. 4A to 4D) of titration associated with the chemical reaction. The data processing unit 106 may then determine an amount of chlorine dioxide 104R to be used in the bleaching sub-process 116 of the pulp process 102. The data processing unit 112 may determine chemical demand of chlorine dioxide 108R for washing loss in the bleaching sub-process.

Figure 3:
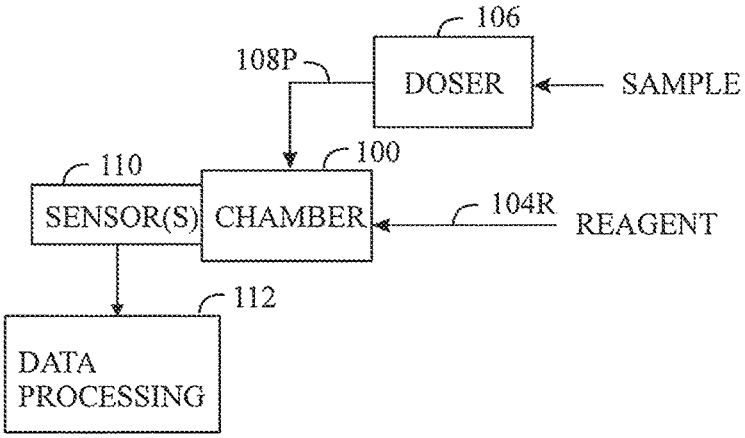
FIG. 3 illustrates an example of measurement of chlorine dioxide by dosing a filtered sample or reference sample to chlorine dioxide.

In an embodiment shown in FIG. 3, the measurement chamber 100 may have chlorine dioxide 104R of a known amount in the measurement chamber 100. Chlorine dioxide may be mixed in another substance. The dosing unit 106 may input a filtered sample 108P to the measurement chamber 100 by increasing the amount of the filtered sample 108P for causing a chemical reaction between chlorine dioxide 104R and the filtered sample 104P. The at least one sensor 110 may perform the detection of the property known to depend on the chemical reaction between chlorine dioxide 104R and the filtered sample 108P simultaneously with the input of the reference sample 108P. The data processing unit 112 may determine the parameter associated with chemical demand of chlorine dioxide 104R on the basis of the endpoint 400 (see FIGS. 4A to 4D) of titration associated with the chemical reaction. The data processing unit 106 may then determine an amount of chlorine dioxide 104R to be used in the bleaching sub-process 116 of the pulp process 102.

In an embodiment, the measurement chamber 100 may have a reference sample 104P. The amount and the chemical demand of the reference sample for chlorine dioxide in the measurement chamber 100 are known. The reference sample 104P may be a filtered sample of pulp. The dosing unit 106 may input chlorine dioxide 108R to the measurement chamber 100 by increasing the amount of chlorine dioxide 108R for causing a chemical reaction between chlorine dioxide 108R and the reference sample 104P. Chlorine dioxide may be input as a mixture having both chlorine dioxide and another substance. Said another substance may be water, for example. The at least one sensor 110 may perform the detection of the property known to depend on the chemical reaction between chlorine dioxide 108R and the reference sample 104P simultaneously with the input of chlorine dioxide 108R. The data processing unit 112 may determine concentration or strength of a substance including chlorine dioxide 108R which is to be used in the bleaching sub-process 116 of the pulp process 102 on the basis of the endpoint 400 (see FIGS. 4A to 4D) of titration associated with the chemical reaction. The data processing unit 106 may then determine an amount of chlorine dioxide 108R to be used in the bleaching sub-process 116 of the pulp process 102 on the basis of the determined concentration. Chlorine dioxide may be used for washing loss.

In an embodiment shown in FIG. 3, the measurement chamber 100 may have chlorine dioxide 104R of a known amount in the measurement chamber 100. Chlorine dioxide may be in a mixture having both chlorine dioxide and another substance. The dosing unit 106 may input a reference sample 108P to the measurement chamber 100 by increasing the amount of the reference sample 108P for causing a chemical reaction between chlorine dioxide 104R and the reference sample 104P. The reference sample 108P may be a filtered sample. The at least one sensor 110 may perform the detection of the property known to depend on the chemical reaction between chlorine dioxide 104R and the reference sample 108P simultaneously with the input of the reference sample 108P. The data processing unit 112 may determine concentration of a substance including chlorine dioxide 104R on the basis of the endpoint 400 (see FIGS. 4A to 4D) of titration associated with the chemical reaction. The data processing unit 106 may then determine an amount of chlorine dioxide 104R to be used in the bleaching sub-process 116 of the pulp process 102 on the basis of the determined concentration. Chlorine dioxide may be used for washing loss.

In an embodiment, the data processing unit 112 may control a present sub-process 114 or a previous sub-process 120 on the basis of the determined parameter of chlorine dioxide, where the parameter may be the chemical demand or concentration of chlorine dioxide which may also determine the chemical demand of the chlorine dioxide in the bleaching sub-process (see FIGS. 4A to 4D and text related thereto).

The previous sub-process 120 may be a pulp washing process. If the determined chlorine dioxide demand is higher than a predetermined threshold, the washing process may be made more effective. The washing process may be made more effective by acquiring a new washer. The washing process may be made more effective by using more water in general. The washing process may be made more effective by using more circulated water. The washing process may be made more effective by using more raw water with or without circulated water. The washing process may be made more effective by making the washing process last longer. The washing process may be made more effective by adding chemical which removes air from the washing process. The washing process may be made more effective by making the washing process direct more force to the pulp. The washing process may be made more effective by compressing dirty water out of the washed pulp mass, for example. In general, the processes of the next sub-process 120 and the bleaching sub-process may be optimized such that combined resources of both of the sub-processes will be minimized.

Figure 4A:
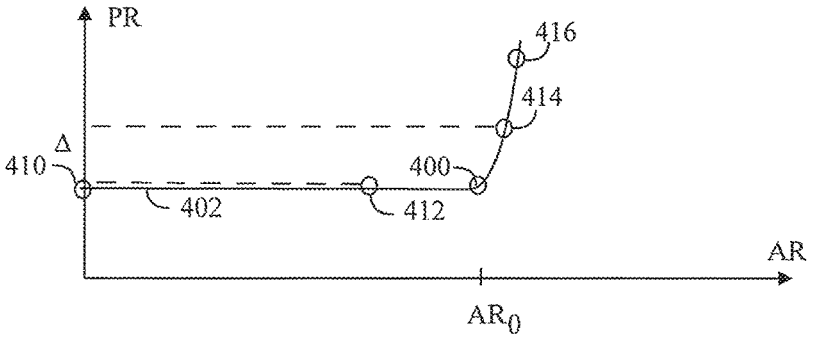
FIG. 4A illustrates an example of a titration curve when chlorine dioxide is gradually dosed to a filtered sample.

FIG. 4A illustrates an example of a titration curve 402 when chlorine dioxide ($ClO_2$) is added gradually into a known volume of filtered sample. The horizontal axis is an amount of chlorine dioxide AR in arbitrary scale and the vertical axis is the detected property PR dependent on the chemical reaction between the first substance 104 and the second substance 108. The detected property PR (amount of free $ClO_2$ in the measurement chamber 100) is measured or otherwise known at the beginning of addition of chlorine dioxide. Because the rate at which the chlorine dioxide is added to the known volume of the filtered sample is known, the horizontal axis corresponds to a time axis in a known manner.

In the example of FIG. 4A, the property may be measured as electric current of an electrochemical sensor 110. The data processing unit 112 determines chemical demand of chlorine dioxide for washing loss in a bleaching sub-process on the basis of at least one value in the detected property. The at least one value may be measured within a known period of time after the input of the second substance 108. The at least one value may be measured at the endpoint 400, after crossing the endpoint 400, or before and after the endpoint 400. The measurement before the endpoint 400 may be performed before addition of the second substance 108 into the measurement chamber 100 which corresponds to point 410. For example, the at least one value may be determined at moments 400, 410, 412, 414 and/or 416. The measurement 412 after addition of the second substance 108 but before the endpoint 400 may not be enough for the measurement alone.

The data processing unit 112 may determine said chemical demand of chlorine dioxide on the basis of one or more differences Δ between a value at the beginning of addition of chlorine dioxide and the at least one value detected after the endpoint 400. FIG. 4A shows only one difference but differences between any values measured at points 410 to 416 may be used. The data processing unit 112 may additionally or alternatively determine the concentration of a substance including chlorine dioxide on the basis of one or more differences between a value before or at the beginning of addition of chlorine dioxide and the at least one value determined after the endpoint 400.

In an embodiment, the data processing unit 112 may search for an endpoint 400 of titration. The endpoint 400 is associated with the chemical reaction. The data processing unit 112 may then determine the parameter associated with the demand of chlorine dioxide on the basis of the endpoint 400, where the parameter may be the chemical demand or the concentration of a substance including chlorine dioxide. The endpoint 400 namely gives a value of the amount of chlorine dioxide $AR_0$ which is needed for the known amount of filtered sample. Even in the case where the endpoint 400 is not directly measured, the demand for chlorine dioxide $AR_0$, which is caused by the effect of washing-loss in the chamber 100, can be estimated on the basis of the at least one measured value. If a measurement is performed at the endpoint 400, the amount of chlorine dioxide at the endpoint 400 may be used for determining the amount of chlorine dioxide to be used in the bleaching sub-process. If no measurement is performed at the endpoint 400, the amount of chlorine dioxide at the endpoint 400 may be interpolated from other measurement values.

The amount of chlorine dioxide needed for the washing loss in the bleaching sub-process can be calculated. If $AR_0$ is the measured demand i.e. needed amount of chlorine dioxide in the measurement chamber 100, $M_0$ is the known volume of the filtered sample and $B_0$ is the amount of washing loss in the bleaching sub-process, the demand $cd_x$ for chlorine dioxide in the bleaching sub-process is a function f of $AR_0$, $M_0$ and $B_0$, $cd_x=f(AR_0, M_0, B_0)$, where f is an elementary or non-elementary function. The dependence between $cd_x$ and $AR_0$, $M_0$ and $B_0$ may simply be $cd_x=(B_0/M_0)\ AR_0$, for example.

The endpoint 400 is related to chlorine dioxide demand for washing loss in the bleaching sub-process 116. The endpoint 400 may also be considered related to a COD (Chemical Oxygen Demand) of the bleaching sub-process 116 but the endpoint 400 gives a better estimate for chlorine dioxide demand. However, if the titration is performed with a reference sample the chemical demand for chlorine dioxide of which is known, the endpoint 400 may be considered to relate to the concentration or strength of a substance comprising chlorine dioxide which, in turn, also may determine the chemical demand for chlorine dioxide of washing loss in a bleaching sub-process.

When chlorine dioxide is progressively added to the measurement chamber 100 which has a filtered sample, the chemical reaction keeps the measured property constant until the titration endpoint 400 is reached. The constant horizontal part of the curve 402 refers to a waste load or dead load of the sample. That is, the sample intakes the amount $AR_0$ of chlorine dioxide before the endpoint 400 but said amount $AR_0$ of chlorine dioxide doesn't cause bleaching of fibers in pulp because chlorine dioxide reacts only with the washing loss. It is only after the endpoint 400 that the added chlorine dioxide will bleach the fibers of the pulp.

The demand of chlorine dioxide is reliably estimated on the basis of the measurement because the measurement may use the very same chlorine dioxide which is to be used in the bleaching sub-process 116. The bleaching sub-process 116 may, in turn, be bleaching the pulp with chlorine dioxide.

Figure 4B:
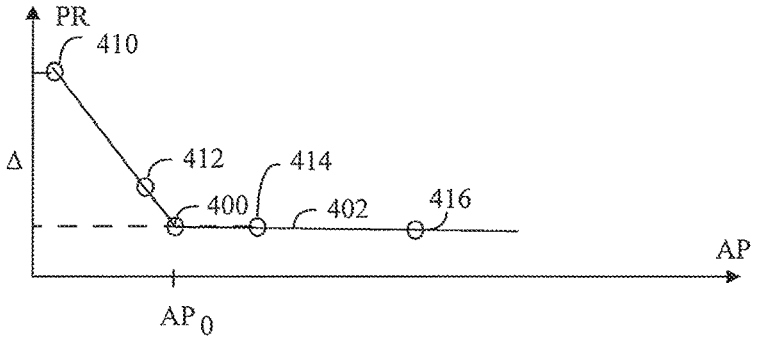
FIG. 4B illustrates an example of a titration curve when a filtered sample or reference sample is gradually dosed to chlorine dioxide.

FIG. 4B illustrates an example of a titration curve 402 when a filtered sample or a reference sample is added gradually into a known volume of a substance comprising chlorine dioxide. The horizontal axis is an amount of the filtered sample or reference sample AP in arbitrary scale and the vertical axis is the detected property PR dependent on the chemical reaction between chlorine dioxide and the filtered sample or reference sample. If the filtered sample or a reference sample is added gradually to a known amount of chlorine dioxide, the curve 402 has high values at first but the values drop rather suddenly down and then much more slowly. That is, the curve 402 is a mirror image of the curve in FIG. 4A. Still, the measured or estimated endpoint 400 determines the chemical demand of chlorine dioxide for washing loss in the bleaching sub-process 116 when a filtered sample is used. Otherwise, the endpoint 400 determines the concentration of chlorine dioxide when a reference sample is used.

In more details, the data processing unit 112 determines the chemical demand of chlorine dioxide for washing loss in a bleaching sub-process on the basis of at least one value in the detected property. At least one value may be measured at or after crossing the endpoint 400. If more than one value is measured, at least one other value may be measured before crossing the endpoint 400. For example, the at least one value may be determined at moments 400, 410, 412, 414 and/or 416. The data processing unit 112 may determine said chemical demand of chlorine dioxide on the basis of one or more differences Δ between a value at the beginning of addition of the filtered sample or the reference sample and the at least one value determined at moments 410 to 416. In such a case, one of the values 410 to 414 on one side of the endpoint 400 and value 416 on the other side of the endpoint may be needed. FIG. 4B shows only one difference but differences between any values measured at points 410 to 416 may be used. The data processing unit 112 may additionally or alternatively determine the concentration of a substance including chlorine dioxide on the basis of one or more differences between a value at the beginning of addition of chlorine dioxide and the at least one value determined within the known period of time at moments 410 to 416.

Figure 4C:
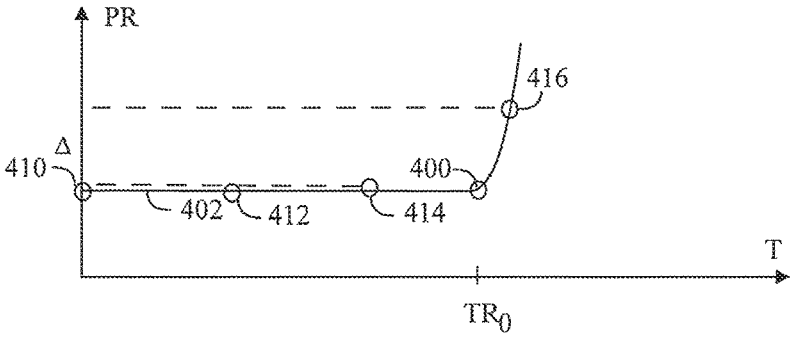
FIG. 4C illustrates an example of a titration curve when chlorine dioxide is dosed to a filtered sample at a time.

FIG. 4C illustrates an example of a titration curve 402 when chlorine dioxide ($ClO_2$) is added at one time into a known volume of filtered sample. The horizontal axis is time T in arbitrary scale and the vertical axis is the detected property PR dependent on the chemical reaction between the first substance 104 and the second substance 108. In this example the amount of chlorine dioxide is so large that it causes the titration to reach the endpoint 400 at some moment $TR_0$.

In more details, the data processing unit 112 determines chemical demand of chlorine dioxide for washing loss in a bleaching sub-process on the basis of at least one value in the detected property after the input of the second substance 108. At least one value may be measured at or after crossing the endpoint 400. If more than one value is measured, at least one other value may be measured before crossing the endpoint 400. For example, the at least one value may be determined at moments 400, 410, 412, 414 and/or 416. In such a case, one of the values 410 to 414 on one side of the endpoint 400 and value 416 on the other side of the endpoint may be needed. The data processing unit 112 may determine said chemical demand of chlorine dioxide on the basis of one or more differences Δ between a value at the beginning of addition of chlorine dioxide and the at least one value detected at moments 410 to 416. FIG. 4C shows only one difference but differences between any values measured at points 410 to 416 may be used. The data processing unit 112 may additionally or alternatively determine the concentration of a substance including chlorine dioxide on the basis of one or more differences between a value at the beginning of addition of chlorine dioxide and the at least one value determined within the known period of time at moments 410 to 416.

In an embodiment, the data processing unit 112 may search for the endpoint 400 of titration associated with the chemical reaction, and determine the parameter on the basis of the endpoint 400, where the parameter may be the chemical demand or the concentration of a substance including chlorine dioxide. The endpoint 400 gives value of the amount of chlorine dioxide $AR_0$ which is needed for the known amount of filtered sample. Even in the case where the endpoint 400 is not directly measured, the demand for chlorine dioxide $AR_0$ caused by the washing-loss in the chamber 100 can be estimated on the basis of the at least one measured value. The moment $TR_0$ is related to the amount of chlorine dioxide $AR_0$ by a speed of the chemical reaction which may be known or estimated, per se, on the basis of general knowledge of chemistry, simulation or measurements. That is, the amount of chlorine dioxide $AR_0$ is a function f of the moment $TR_0$, $AR_0=f(TR_0)$, where f is an elementary or non-elementary function. The amount of chlorine dioxide $AR_0$ may simply be $AR_0=kTR_0$, where k is a constant depending the speed of the chemical reaction. Because it is also known how much pulp is going to be bleached in the bleaching sub-process, the amount of chlorine dioxide needed for the washing loss in the bleaching sub-process can be calculated. If $AR_0$ is the measured demand i.e. needed amount of chlorine dioxide in the measurement chamber 100, $M_0$ is the known volume of the filtered sample which corresponds to the washing loss of the pulp and $B_0$ is the amount of pulp to be bleached in the bleaching sub-process, the demand $cd_x$ for chlorine dioxide caused by the washing loss in the bleaching sub-process is a function f of $AR_0$, $M_0$ and $B_0$, $cd_x=f(AR_0, M_0, B_0)$, where f is an elementary or non-elementary function. The dependence between $cd_x$ and $AR_0$, $M_0$ and $B_0$ may simply be $cd_x=(B_0/M_0)\ AR_0$, for example.

Figure 4D:
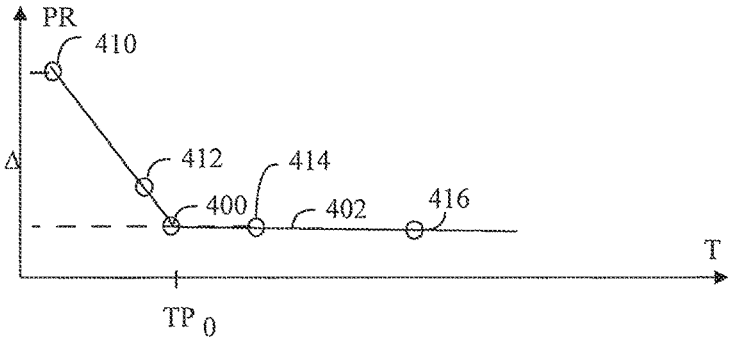
FIG. 4D illustrates an example of a titration curve when a filtered sample or reference sample is dosed to chlorine dioxide at a time.
Figure 5:
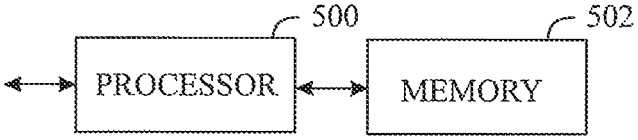
FIG. 5 illustrates an example of a processing unit.

FIG. 4D illustrates an example of a titration curve 402 when a filtered sample or a reference sample is added at one moment into a known volume of chlorine dioxide. The horizontal axis is time T in arbitrary scale and the vertical axis is the detected property PR dependent on the chemical reaction between chlorine dioxide and the pulp or reference sample. In this example the amount of chlorine dioxide in the measurement chamber 100 is higher than the chemical demand of the filtered sample input at one time which causes the titration to reach the endpoint 400 at some moment $TR_0$ after which the titration continues beyond the endpoint 400. The curve 402 has high values at first but the values drop rather suddenly down at the moment $TR_0$ and thereafter the drop is more slowly. That is, the curve 402 is a mirror image of the curve in FIG. 4C.

In more details, the data processing unit 112 determines chemical demand of chlorine dioxide for washing loss in a bleaching sub-process on the basis of at least one value in the detected property after the input of the second substance 108. At least one value may be measured at or after crossing the endpoint 400. If more than one value is measured, at least one other value may be measured before crossing the endpoint 400. For example, the at least one value may be determined at moments 400, 410, 412, 414 and/or 416. The data processing unit 112 may determine said chemical demand of chlorine dioxide on the basis of one or more differences Δ between a value at the beginning of addition of the filtered sample or the reference sample and the at least one value determined within the known period of time at moments 410 to 416. FIG. 4D shows only one difference but differences between any values measured at points 410 to 416 may be used. The data processing unit 112 may additionally or alternatively determine the concentration of a substance including chlorine dioxide on the basis of one or more differences between a value at the beginning of addition of chlorine dioxide and the at least one value determined within the known period of time at moments 410 to 416.

In an embodiment, the data processing unit 112 may search for the endpoint 400 of titration associated with the chemical reaction, and determine the parameter on the basis of the endpoint 400, where the parameter may be the chemical demand or the concentration of a substance including chlorine dioxide. The endpoint 400 gives value of the amount of chlorine dioxide $AR_0$ which is needed for the known amount of filtered sample which corresponds to the washing loss. Even in the case where the endpoint 400 is not directly measured, the demand for chlorine dioxide $AR_0$ caused by the washing-loss in the chamber 100 can be estimated on the basis of the at least one measured value. The moment $TR_0$ is related to the amount of chlorine dioxide $AR_0$, as already explained in relation to FIG. 4C, by a speed of the chemical reaction which is known, per se, on the basis of general knowledge of chemistry, simulation or measurements. Thus, the endpoint 400 determines the chemical demand of chlorine dioxide for the washing loss in the bleaching sub-process 116 when a filtered sample is used. Otherwise, the endpoint 400 determines the concentration of a substance including chlorine dioxide when a reference sample is used.

Chlorine dioxide for bleaching is typically easily available in the bleaching facility. The concentration of a substance comprising chlorine dioxide is often known rather well which may give a reference how to dose chlorine dioxide to the bleaching sub-process 116 in addition to the measurement. However, it is also possible to measure the concentration of the substance including chlorine dioxide. Even in the case the concentration of the substance including chlorine dioxide is not known and/or the concentration of the substance including chlorine dioxide is varying, the bleaching sub-process 116 can be performed effectively because chlorine dioxide is also used in the bleaching sub-process 116. That is, the measurement takes into account the present concentration of the substance including chlorine dioxide in all circumstances.

In an embodiment, the data processing unit 112 may control the next sub-process 116 on the basis of the determined concentration of the substance including chlorine dioxide. A substance including chlorine dioxide may be input to the measurement chamber 100 as a function of the concentration of chlorine dioxide. That is, the concentration of chlorine dioxide is used for determining the chemical demand of chlorine dioxide in bleaching. Thus, a substance having a high concentration of chlorine dioxide may be input less than a substance having a low concentration of chlorine dioxide. The next sub-process 116 may be brown pulp washing process. The brown pulp may also be called kraft pulp.

In an embodiment, the measurement chamber 100 may have the filtered sample from a kraft process. Then, the demand of chlorine dioxide may be determined on the basis of the endpoint 400.

In an embodiment, the filtered sample from the kraft process may have known chemical demand for chlorine dioxide and the measurement may determine a concentration of a substance having chlorine dioxide to be used in the next bleaching sub-process 116. Because the kraft sample is known and the amount $AR_0$ of chlorine dioxide required to reach the endpoint 400 is known, the demand for chlorine dioxide caused by the washing loss in the next sub-process 116 can be estimated, because the amount of pulp processed in the next sub-process 116 is known. That is, $D>f(AR_0)$, where D is the demand of chlorine dioxide in the next sub-process 116 and f is a known function based on the amount of pulp in the next sub-process 116.

In an embodiment, the data processing unit 112 may additionally determine quality of a washing sub-process of the kraft pulp on the basis of the endpoint 400 (see FIGS. 4A to 4D). The washing process may be the present sub-process 114 before inputting the washed kraft pulp to the next sub-process 116 which may be a bleaching sub-process.

In an embodiment, the processing unit 112 comprises at least one processor 500 and at least one memory 502 including a computer program code, wherein the at least one memory 502 and the computer program code with the at least one processor 500 cause the processing unit 112 at least to determine the parameter associated with chlorine dioxide of the pulp process 102, on the basis of the detection of the property by the at least one sensor 110. The parameter may be the chemical demand of chlorine dioxide or the concentration of a substance including chlorine dioxide In an embodiment, the at least one memory 502 and the computer program code with the at least one processor 500, cause the apparatus to control the dosing unit 106 to input the second substance 108, 108P, 108R to the measurement chamber 100.

The control may be performed such that the processing unit 112 sends a control command to the dosing unit 106 which doses chlorine dioxide or the filtered sample to the chamber 100 according the command. If the command requests the dosing unit 106 to add chlorine dioxide or the filtered sample, the dosing unit 106 adds chlorine dioxide or the filtered sample to the chamber 100. If the command requests the dosing unit 106 to stop inputting chlorine dioxide or the filtered sample, the dosing unit 106 stops inputting chlorine dioxide or the filtered sample to the chamber 100. Instead of the filtered sample, the reference sample may be used.

Figure 6:
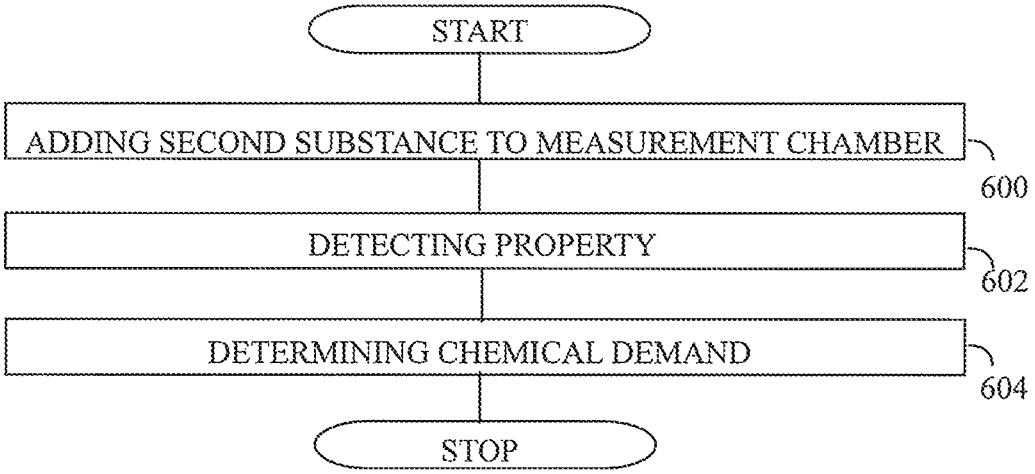
FIG. 6 illustrates an example of a flow chart of measurement method.

FIG. 6 illustrates the measurement method. In step 600, a second substance 104, 104P, 104R associated with the pulp process 102 is input by a dosing unit 106 to the measurement chamber 100 for causing a chemical reaction between a first substance 108, 108P, 108R and the second substance 104, 104P, 104R while having the first substance 108, 108P, 108R associated with a pulp process 102 in the measurement chamber 100, the amount of the first substance 108, 108P, 108R being known, one of the first substance 104, 104R and the second substance 108, 108R comprising chlorine dioxide and another of the first substance 104, 104R and the second substance 108, 108R being filtered sample from pulp slurry of a pulp process 102. In step 602, detection of a property known to depend on the chemical reaction between the first substance 108, 108P, 108R and the second substance 104, 104P, 104R is performed by at least one sensor 110 as a function of time. In step 604, an endpoint 400 of titration associated with the chemical reaction is searched for, by a data processing unit 112. In step 606, chemical demand for chlorine dioxide for washing loss in bleaching is determined by a data processing unit 112 on the basis of at least one value in the detected property within a known period of time after the input of the second substance 108.

The method steps of FIG. 6 may be performed by a computer program performed using the processing unit 112 comprising the at least one processor 500 and the at least one memory 502.

Instead of or in addition to using a processor and memory, the processing unit may be implemented as one or more integrated circuits, such as an application-specific integrated circuit ASIC. Other equipment embodiments are also feasible, such as a circuit constructed of separate logic devices. A hybrid of these different implementations is also possible.

The computer program may be placed on a computer program distribution means for the distribution thereof. The computer program distribution means is readable by means of a data processing unit 112, and it may encode the computer program commands to control the operation of the apparatus determining a parameter associated with chlorine dioxide.

The distribution means, in turn, may be a solution known per se for distributing a computer program, for instance a computer-readable medium, a program storage medium, a computer-readable memory, a computer-readable software distribution package or a computer-readable compressed software package.

It will be obvious to a person skilled in the art that, as the technology advances, the inventive concept can be implemented in various ways. The invention and its embodiments are not limited to the examples described above but may vary within the scope of the claims.

What is claimed is:

1. A measurement method, the method comprising inputting, by a dosing unit, a second substance associated with a pulp process to the measurement chamber for causing a chemical reaction between a first substance and the second substance while having the first substance associated with the pulp process in the measurement chamber, the amounts of the first substance and the second substance input to the measurement chamber being known, one of the first substance and the second substance comprising chlorine dioxide and another of the first substance and the second substance being filtered sample from pulp slurry of the pulp process;

performing, by at least one sensor, detection, directly or indirectly, of an amount of chlorine dioxide as a detected property; and determining, by a data processing unit, a parameter associated with chemical demand of chlorine dioxide for washing loss in a bleaching sub-process on the basis of one or more values in the detected property at least one of which being detected at or after crossing an endpoint.

2. The method of claim 1, the method further comprising determining, by a data processing unit, the detected property associated with chemical demand of chlorine dioxide for washing loss in a bleaching sub-process on the basis of the endpoint of the detected property of the chemical reaction.

3. The method of claim 1, the method further comprising inputting, by a dosing unit, the second substance associated with the pulp process to the measurement chamber by increasing the amount of the second substance as a function of time for causing the chemical reaction between the first substance and the second substance;

performing, by the at least one sensor, detection of the detected property simultaneously with the input of the second substance.

4. The method of claim 1, the method further comprising inputting chlorine dioxide to the measurement chamber which has the filtered sample, the input amount of chlorine dioxide at one time being higher than the chemical demand for the filtered sample.

5. The method of claim 1, the method further comprising inputting the filtered sample to the measurement chamber which has chlorine dioxide, the amount of chlorine dioxide in the measurement chamber being higher than the chemical demand for the filtered sample input at one time.

6. The method of claim 1, the method further comprising having a filtered sample of a known amount from a present sub-process of the pulp process in the measurement chamber;

inputting chlorine dioxide used in the bleaching sub-process next to the present sub-process to the measurement chamber by increasing the amount of chlorine dioxide as a function of time for causing a chemical reaction between chlorine dioxide and the filtered sample; and performing the detection of the detected property simultaneously with the input of chlorine dioxide.

7. The method of claim 1, the method further comprising having chlorine dioxide of a known amount from a present sub-process of the pulp process in the measurement chamber;

inputting the filtered sample to the measurement chamber by increasing the amount of the filtered sample as a function of time for causing a chemical reaction between chlorine dioxide and the filtered sample; and performing the detection of the detected property simultaneously with the input of chlorine dioxide.

* * * * *